US006837069B2

(12) United States Patent
Takeuchi et al.

(10) Patent No.: US 6,837,069 B2
(45) Date of Patent: Jan. 4, 2005

(54) REFRIGERANT CYCLE WITH EJECTOR

(75) Inventors: Masayuki Takeuchi, Nukata-gun (JP); Yoshitaka Tomatsu, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/619,795

(22) Filed: Jul. 15, 2003

(65) Prior Publication Data

US 2004/0011065 A1 Jan. 22, 2004

(30) Foreign Application Priority Data

Jul. 16, 2002 (JP) ..... 2002-206552

(51) Int. Cl.[7] ..... F25B 1/06
(52) U.S. Cl. ..... 62/500; 62/512
(58) Field of Search ..... 62/500, 503, 509, 62/512

(56) References Cited

U.S. PATENT DOCUMENTS 5,343,711 A * 9/1994 Kornhauser et al. ..... 62/116
5,890,370 A 4/1999 Sakakibara et al.
6,477,857 B2 * 11/2002 Takeuchi et al. ..... 62/500

FOREIGN PATENT DOCUMENTS

JP 6-2964 1/1994
JP 2003-74992 3/2003

* cited by examiner

*Primary Examiner*—Melvin Jones
(74) *Attorney, Agent, or Firm*—Harness, Dickey & Pierce, PLC

(57) ABSTRACT

In a refrigerant cycle with an ejector, there is provided with a bypass passage through which a part of high-pressure refrigerant from a radiator flows into a low-pressure refrigerant passage between an evaporator and a suction port of the ejector while bypassing a nozzle of the ejector. Further, a control valve is disposed to open the bypass passage so that refrigerant flows through the bypass passage when the pressure of the high-pressure refrigerant becomes in a predetermined condition. Accordingly, it can prevent the pressure of the high-pressure refrigerant from being excessively increased due to increase of a refrigerant flow amount. Therefore, the refrigerant cycle operates stably.

9 Claims, 7 Drawing Sheets

REFRIGERANT CYCLE WITH EJECTOR

CROSS-REFERENCE TO RELATED APPLICATION

This application is related to and claims priority from Japanese Patent Application No. 2002-206552 filed on Jul. 16, 2002, the contents of which are hereby incorporated by reference.

BACKGROUND OF THE INVENTION

1. Field of the Invention

The present invention relates to a refrigerant cycle including an ejector. The refrigerant cycle is provided with a bypass passage through which a part of high-pressure refrigerant from a radiator bypasses a nozzle of the ejector, and a control valve that opens the bypass passage when the pressure of the high-pressure refrigerant is higher than a valve-opening pressure of the control valve.

2. Description of Related Art

In a refrigerant cycle (ejector cycle) described in JP-A-6-2964, refrigerant is decompressed and expanded in a nozzle of an ejector so that gas refrigerant evaporated in an evaporator is sucked, and pressure of refrigerant to be sucked into a compressor is increased by converting expansion energy to pressure energy. For example, a conventional refrigerant cycle shown in FIG. 13 includes a compressor 101 for compressing refrigerant, a radiator 102 for cooling high-pressure refrigerant discharged from the compressor 101, an ejector 103, a gas-liquid separator 104, a flow control valve 105 and an evaporator 106. Further, the ejector 103 is constructed with a nozzle 131, a suction port 132, a mixing portion 33 and a diffuser 134. The nozzle 131 decompresses the high-pressure refrigerant introduced from the radiator 102 to a high-pressure refrigerant inlet 131*a*, so that low-pressure refrigerant evaporated in the evaporator 106 is sucked from the suction port 132 into the mixing portion 133 by a high-speed refrigerant stream jetted from an outlet 131*c* of the nozzle 131. The sucked refrigerant from the evaporator 106 and the jetted refrigerant from the nozzle 131 are mixed in the mixing portion 133. Further, the mixing portion 133 and the diffuser 134 increase the refrigerant pressure by converting the speed energy of refrigerant to the pressure energy of refrigerant. Thereafter, refrigerant flows into the gas-liquid separator 104 from an ejector outlet 135.

In the ejector cycle, because a sectional area of a throat portion 131*b* of the nozzle 131 is fixed, a flow amount of refrigerant flowing into the nozzle 131 of the ejector 103 cannot be adjusted based on operation condition (e.g., cooling load) of the refrigerant cycle. When the refrigerant cycle is used for a vehicle air conditioner, the compressor 101 is generally driven by a vehicle engine, and a rotational speed of the compressor 101 is largely changed due to a rotation speed of the vehicle engine. Accordingly, the refrigerant pressure may be excessively increased, and the efficiency of the refrigerant cycle may be greatly deteriorated. Further, when carbon dioxide is used as the refrigerant, the pressure of high-pressure refrigerant is greatly changed, so it is difficult to stably operate the refrigerant cycle.

SUMMARY OF THE INVENTION

In view of the foregoing problems, it is an object of the present invention to provide a refrigerant cycle having an ejector, which prevents a refrigerant pressure from being greatly increased due to increase of a refrigerant flow amount.

It is another object of the present invention to provide a refrigerant cycle which effectively improves cooling capacity when the refrigerant cycle is used as a refrigerator.

According to the present invention, a refrigerant cycle includes a compressor for compressing refrigerant, a high-pressure heat exchanger for radiating heat of high-pressure refrigerant discharged from the compressor, a low-pressure heat exchanger for evaporating low-pressure refrigerant after being decompressed, an ejector, and a gas-liquid separator for separating refrigerant from the ejector into gas refrigerant and liquid refrigerant. The ejector includes a nozzle for decompressing and expanding refrigerant flowing from the high-pressure heat exchanger by converting pressure energy of refrigerant to speed energy of the refrigerant, and a pressure-increasing portion that is disposed to increase a pressure of refrigerant by converting the speed energy of refrigerant to the pressure energy of refrigerant while mixing refrigerant injected from the nozzle and refrigerant sucked from the low-pressure heat exchanger. In the refrigerant cycle, a control valve is disposed in a bypass passage through which a part of refrigerant from the high-pressure heat exchanger flows into a low-pressure refrigerant passage between the low-pressure heat exchanger and a suction port of the ejector, and the control valve opens the bypass passage so that refrigerant flows through the bypass passage when a pressure of the refrigerant from the high-pressure heat exchanger becomes in a predetermined condition. Accordingly, it can prevent the pressure of the high-pressure refrigerant from being excessively increased due to increase of a refrigerant flow amount, and the refrigerant cycle operates stably. Thus, even when the refrigerant flow amount increases, the power consumed in the compressor can be restricted from being increased, and the efficiency (COP) of the refrigerant cycle can be improved.

Refrigerant bypassing the nozzle of the ejector is decompressed in the control valve and is sucked into the pressure increasing portion of the ejector together with the refrigerant from the low-pressure heat exchanger, and is mixed with the refrigerant jetted from the nozzle of the ejector. Thereafter, the mixed refrigerant flows into the gas-liquid separator from the outlet of the ejector, and liquid refrigerant separated in the gas-liquid separator flows into the low-pressure heat exchanger. Accordingly, when the refrigerant cycle is used as a refrigerator, the cooling capacity of the low-pressure heat exchanger can be increased even in a cool-down operation.

For example, the control valve includes a housing for defining a part of a high-pressure refrigerant passage from the high-pressure heat exchanger to the nozzle of the ejector, a valve port through which the high-pressure refrigerant passage communicates with the bypass passage, a case member for forming a seal space in which a gas refrigerant is sealed by a predetermined density, a displacement member that displaces in accordance with a pressure difference between inside and outside of the seal space, and a valve body that opens and closes the valve port in accordance with a displacement of the displacement member. In this case, the seal space is placed in the high-pressure refrigerant passage of the housing, and the displacement member moves in a direction for opening the valve port when a pressure in the high-pressure refrigerant passage is higher than the inside pressure of the seal space. Therefore, a valve-opening pressure of the control valve is changed in accordance with the temperature of the high-pressure refrigerant, and the COP of the refrigerant cycle can be effectively improved.

Preferably, the refrigerant cycle includes an inner heat exchanger for performing a heat exchange between refrigerant to be sucked into the compressor and refrigerant flowing from the high-pressure heat exchanger. In this case, the high-pressure refrigerant passage includes a first high-pressure refrigerant passage through which refrigerant from the high-pressure heat exchanger flows to the inner heat exchanger, and a second high-pressure refrigerant passage through which refrigerant from the inner heat exchanger flows to the nozzle of the ejector. Further, the seal space is placed at least in the first high-pressure refrigerant passage of the housing, and the displacement member moves in the direction for opening the valve port when a pressure in the first high-pressure refrigerant passage is higher than the inside pressure of the seal space.

Alternatively, the control valve is disposed to open the bypass passage, when a pressure difference between a pressure of refrigerant flowing from the high-pressure heat exchanger at a position upstream from the control valve and a pressure of refrigerant at an outlet side of the low-pressure heat exchanger at a position downstream from the control valve is larger than a predetermined value. In this case, the valve-opening pressure of the control valve is also changed in accordance with the pressure of the refrigerant at the outlet side of the low-pressure heat exchanger. Accordingly, when the low-pressure heat exchanger is used as an evaporator, the valve-opening pressure of the control valve is changed in accordance with a cooling load of the evaporator, and the COP of the refrigerant cycle can be effectively improved while power consumed in the compressor can be reduced.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the appended drawings.

(First Embodiment)

Figure 1:
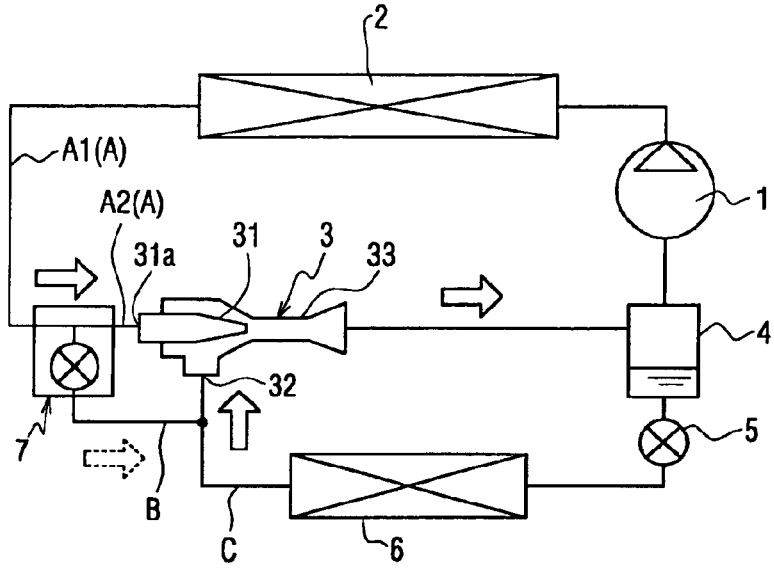
FIG. 1 is a schematic diagram showing a refrigerant cycle with an ejector according to a first preferred embodiment of the present invention.

In the first embodiment, carbon dioxide is typically used as refrigerant in a refrigerant cycle. As shown in FIG. 1, a compressor 10 is disposed for sucking and compressing refrigerant circulated in the refrigerant cycle. A radiator 2 is a high-pressure heat exchanger for cooling high-temperature and high-pressure refrigerant discharged from the compressor 10 by performing heat-exchange operation between air (e.g., outside air) blown by a blower and the high-temperature and high-pressure refrigerant. An ejector 3 is disposed for decompressing refrigerant from the radiator 2, and a gas-liquid separator 4 is disposed to separate refrigerant discharged from the ejector 3 into gas refrigerant and liquid refrigerant. Further, an evaporator 6 is a low-pressure heat exchanger in which refrigerant is evaporated by absorbing heat from air (e.g., inside air) blown by a blower (not shown). A flow control valve 5 is disposed in a refrigerant passage between the gas-liquid separator 4 and the evaporator 6. As the flow control valve 5, a super-heating degree control valve or a fixed throttle or the like can be used. The gas-liquid separator 4 includes a gas-refrigerant outlet connected to a suction port of the compressor 1, and a liquid-refrigerant outlet coupled to an inlet of the evaporator 30.

The ejector 3 sucks refrigerant evaporated in the evaporator 30 while decompressing and expanding refrigerant flowing out from the radiator 2 in a nozzle 31, and increases pressure of refrigerant to be sucked into the compressor 10 by converting expansion energy to pressure energy. The ejector 3 includes the nozzle 31, and a pressure-increasing portion 33 including a mixing portion and a diffuser. The nozzle 31 decompresses and expands high-pressure refrigerant flowing into the ejector 3 by converting pressure energy of the high-pressure refrigerant from the radiator 2 to speed energy thereof. The mixing portion of the pressure-increasing portion 33 sucks refrigerant evaporated in the evaporator 6 from a suction port 32 by using an entrainment function of high-speed refrigerant stream injected from the nozzle 31, and mixes the sucked refrigerant and the injected refrigerant. Further, the diffuser of the pressure-increasing portion 33 mixes the refrigerant injected from the nozzle 31 and the refrigerant sucked from the evaporator 6. Therefore, the refrigerant pressure is increased in the pressure-increasing portion 33 including the mixing portion and the diffuser, by converting speed energy of the mixed refrigerant to pressure energy thereof.

The radiator 2 and the nozzle 31 of the ejector 3 are coupled through a refrigerant passage A (A1, A2). A refrigerant bypass passage B is provided in the refrigerant passage A to be branched from the refrigerant passage A, and communicates with a refrigerant passage C through which refrigerant is sucked from the evaporator 6 to the suction port 32 of the ejector 3. Therefore, the refrigerant passage A is divided into an upstream part A1 and a downstream part A2 by a branched portion of the refrigerant bypass passage B. A control valve 7 is disposed in the branch portion so as to control a flow amount of refrigerant flowing from the radiator 2 to the nozzle 31 of the ejector 3 and a flow amount of refrigerant flowing through the refrigerant bypass passage B while bypassing the nozzle 31.

Figure 2:
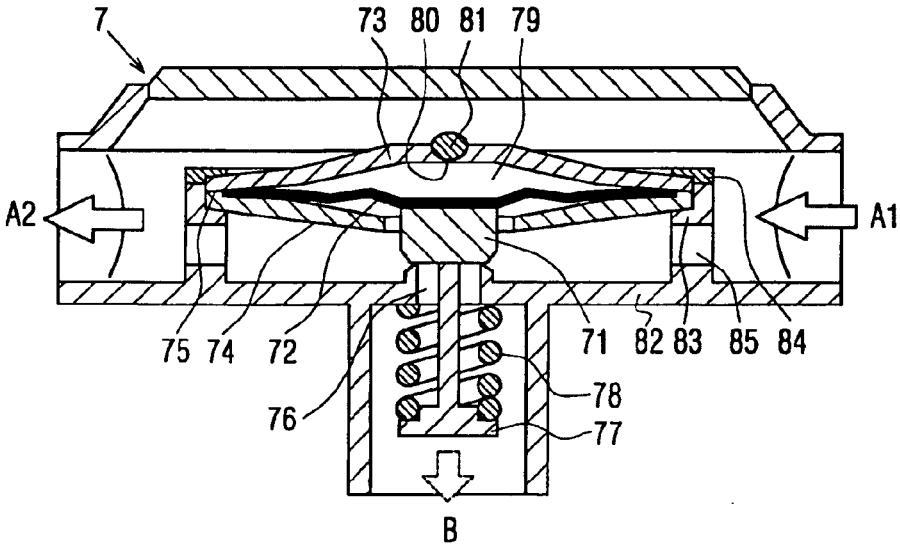
FIG. 2 is a cross-sectional view showing a control valve used for the refrigerant cycle according to the first embodiment.

FIG. 2 shows the structure of the control valve 7 used in the refrigerant cycle of the first embodiment. The control valve 7 has a housing 82 for defining a part of the high-pressure refrigerant passage A between the radiator 2 and the nozzle 31 of the ejector 3. The control valve 7 includes a valve body 71 and a diaphragm 72 connected to the valve body 71. The diaphragm 72 is inserted between an upper case 73 and a lower case 74, and thereafter, a peripheral portion 75 of the upper case 73 and the lower case 74 is welded. A valve port 76 is provided in the housing 82 to communicate with the bypass passage B. That is, through the valve port 76, the high-pressure refrigerant passage A communicates with the bypass passage B. The valve body 71 moves vertically in FIG. 2, in accordance with a displacement of the diaphragm 72 so as to open and close the valve port 76 communicating with the bypass passage B.

A seal space 79 is defined by the upper case 73 and the diaphragm 72, and is positioned in the high-pressure refrigerant passage A in the housing 82 of the control valve 7. Carbon dioxide is sealingly stored in the seal space 79, so that the carbon dioxide sealed in the seal space 79 has a density of about 600 $Kg/m^3$ when the valve body 71 closes the valve port 76. A sealing port 80 from which carbon dioxide is introduced into the seal space 79 is provided in the upper case 73, and is sealed by a sealing member 81 by welding or brazing after carbon dioxide is filled. Generally, high-pressure refrigerant flowing from the radiator 2 toward the ejector 3 flows through the control valve 7 around the upper case 73 and the lower case 74. In this case, the temperature in the seal space 79 is approximately equal to the temperature of the high-pressure refrigerant in the high-pressure refrigerant passage A.

In the first embodiment, after the upper case 73, the diaphragm 72 and the lower case 74 are welded, the welded member is fixed to a stay 83 provided in the housing 82 by screwing, welding or the like. For example, the welded member is fixed to the stay 83 by using a fastening member 84 such as a clip. As shown in FIG. 2, a refrigerant passage 85 is provided under the lower case 74. Further, a rod 77 is connected to the valve body 71, and a coil spring 78 is disposed between the rod 77 and the valve body 71 so that the spring force of the coil spring 78 is applied to the valve body 71 in a valve-closing direction.

When the refrigerant pressure becomes lower than the critical pressure of the refrigerant and gas-liquid refrigerant flows through the control valve 7, the temperature inside the seal space 79 becomes substantially equal to the temperature of high-pressure refrigerant in the high-pressure refrigerant passage A around the seal space 79, and the pressure inside the seal space 79 becomes substantially equal to the pressure of the high-pressure refrigerant. In this case, the valve body 71 closes the valve port 76, and refrigerant does not flow through the bypass passage B. Thereafter, when the pressure of the high-pressure refrigerant becomes higher than a predetermined pressure, the control valve 7 opens the bypass passage B. For example, the spring force of the coil spring 78 can be set at about 0.6 MPa when being calculated by the pressure in the diaphragm 72.

Figure 3:
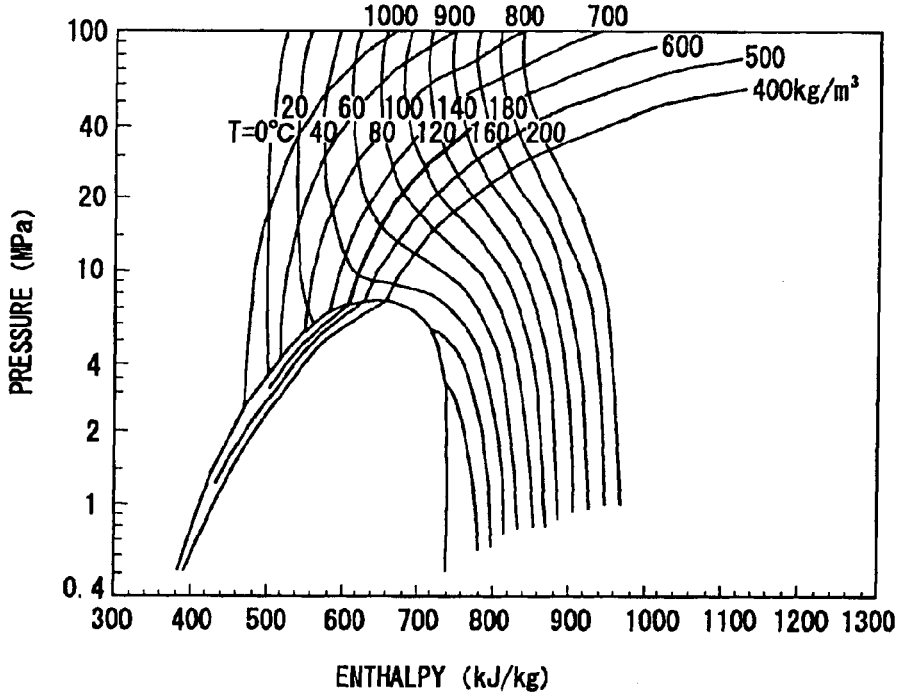
FIG. 3 is a Mollier diagram (p-h diagram) of carbon dioxide in the refrigerant cycle.

Next, operation of the control valve 7 will be now described in detail. Because carbon dioxide is sealed in the seal space 79 by about 600 $kg/m^3$, the inside pressure of the seal space 79 changes along the isodensity line of 600 $kg/m^3$ as indicated in the Mollier diagram of carbon dioxide in FIG. 3. When the temperature inside the seal space 79 is 40° C., the inside pressure of the seal space 79 is about 9.7 MPa. Accordingly, when the pressure of the high-pressure refrigerant is lower than a valve-opening pressure of 10.3 MPa that is the total pressure of the inside pressure of the seal space 79 and the pressure due to the spring force, the valve body 71 closes the valve port 76 so that refrigerant does not flows through the bypass passage B. Conversely, when the pressure of the high-pressure refrigerant is higher than 10.3 Mpa, the valve body 71 opens the valve port 76 so that refrigerant flows through the bypass passage B.

Next, the operation of the refrigerant cycle will be described. When the flow amount of refrigerant is small and the pressure of the high-pressure refrigerant is lower than the valve-opening pressure of the control valve 7, the control valve 7 is closed to close the bypass passage B. In this case, all of the refrigerant flowing from the radiator 2 passes through the nozzle 31 of the ejector 3. Accordingly, all of the refrigerant discharged from the radiator 2 is decompressed in the nozzle 31 of the ejector 3. By the high-speed injection of refrigerant from the nozzle 31, gas refrigerant evaporated in the evaporator 6 is sucked into the pressure-increasing portion 33 of the ejector 3 from the suction port 32. The refrigerant from the nozzle 31 and the refrigerant sucked from the evaporator 6 are mixed in the mixing portion of the pressure increasing portion 33, and the pressure of the mixed refrigerant increases while flowing through the pressure-increasing portion 33 of the ejector 3. Thereafter, refrigerant from the ejector 3 flows into the gas-liquid separator 4. In this case, because refrigerant in the evaporator 6 is sucked to the suction port 32 of the ejector 3, refrigerant from the gas-liquid separator 4 circulates the flow amount valve 5, the evaporator 6 and the pressure-increasing portion 33 of the ejector 3 in this order, and returns to the gas-liquid separator 4.

On the other hand, when the flow amount of the refrigerant increases and the pressure of the high-pressure refrigerant becomes higher than the valve-opening pressure of the control valve 7, the control valve 7 is opened to open the bypass passage B so that a part of refrigerant flowing from the radiator 2 flows into the bypass passage B after being decompressed in the control valve 7. Refrigerant flowing through the refrigerant bypass passage B flows into the refrigerant passage C between the evaporator 6 and the suction portion 32 of the ejector 3. Refrigerant flowing into the refrigerant passage C is mixed with the refrigerant flowing from the evaporator 6, and the mixed refrigerant is sucked into the ejector 3 from the suction portion 32.

According to the first embodiment of the present invention, the bypass passage B through which a part of refrigerant from the radiator 2 flows from an upstream portion that is upstream of the high-pressure refrigerant inlet portion 31*a* of the ejector 3 is provided, and the control valve 7 is provided in the bypass passage B such that the control valve 7 is opened to open the bypass passage B when the pressure of high-pressure refrigerant flowing from the radiator 2 is higher than the valve-opening pressure of the control valve 7. That is, when the refrigerant flow amount increases and the pressure of the high-pressure refrigerant is increased more than a necessary pressure, a part of refrigerant from the radiator 2 is branched to flow through the bypass passage B while bypassing the nozzle 31 of the ejector 3. Therefore, it can prevent the pressure of high-pressure refrigerant from being excessively increased, and the refrigerant cycle operates stably. Thus, it can restrict the consumed power of the compressor 1 from being increased even when the refrigerant flow amount increases, and the efficiency of the refrigerant cycle can be improved.

Further, refrigerant passing through the bypass passage B is sucked into the ejector 3 together with the refrigerant from the evaporator 6, and is mixed with the refrigerant jetted from the nozzle 31. Thereafter, the mixed refrigerant flows into the gas-liquid separator 4 from the outlet of the ejector 3. Accordingly, even when a part of refrigerant bypasses the nozzle 31 of the ejector 3, the flow amount of refrigerant flowing into the gas-liquid separator 4 is not decreased. Accordingly, it is possible to supply a sufficient amount of liquid refrigerant to the evaporator 6 from the gas-liquid separator 4, and cooling capacity can be sufficiently obtained in the evaporator 6 even in a cool-down operation.

In the first embodiment, a part of the high-pressure refrigerant passage A from the radiator 2 to the ejector 3 is formed in the control valve 77. Further, the high-pressure refrigerant passage A communicates with the bypass passage B through the valve port 76 of the control valve 77, and the seal space 79 sealed with the gas refrigerant by a predetermined density is provided within the high-pressure refrigerant passage A. Therefore, the diaphragm 72 (displacement member) is moved in accordance with a pressure difference between the inside pressure of the seal space 79 and the outside pressure of the seal space 79 within the high-pressure refrigerant passage A, and the valve body 71 moves in accordance with the movement of the diaphragm 72 to open and close the valve port 76. Accordingly, when the pressure of high-pressure refrigerant in the high-pressure refrigerant passage A is lower than the inside pressure of the seal space 79, all of the refrigerant flowing from the radiator 2 passes through the nozzle 31 of the ejector 3. On the other hand, when the pressure of high-pressure refrigerant in the high-pressure refrigerant passage A is higher than the inside pressure of the seal space 79, a part of the refrigerant flowing from the radiator 2 passes through the bypass passage B while bypassing the nozzle 31 of the ejector 3. Accordingly, it can prevent the pressure of high-pressure refrigerant from being excessively increased due to increase of the refrigerant flow amount.

Further, according to the first embodiment, because the inside pressure of the seal space 79 in the control valve 7 changes in accordance with the temperature of the high-pressure refrigerant flowing from the radiator 2, the valve-opening pressure of the control valve 7 also changes in accordance with the temperature of the high-pressure refrigerant. Accordingly, the valve-opening pressure of the control valve 7 can be set to approximately correspond to the optimum control line where the efficiency (COP) of the refrigerant cycle becomes maximum. Therefore, the operation of the refrigerant cycle can be stably performed while the COP of the refrigerant cycle can be improved.

(Second Embodiment)

Figure 4:
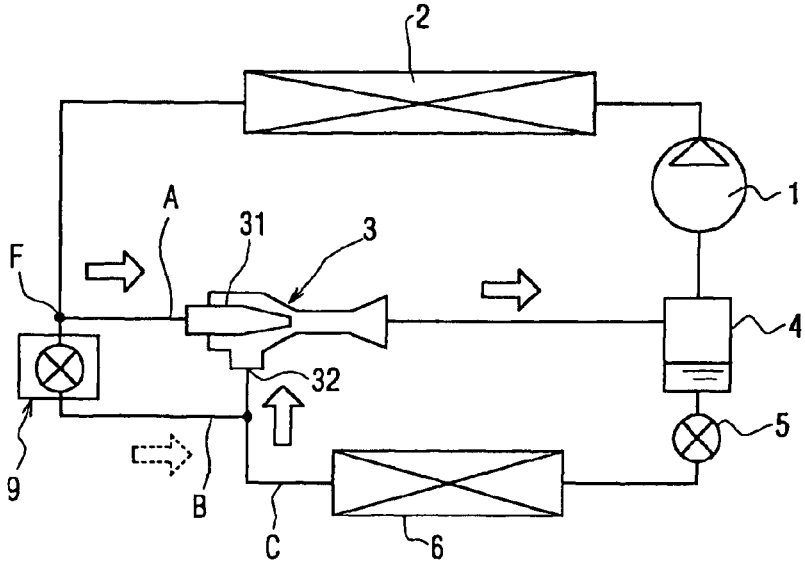
FIG. 4 is a schematic diagram showing a refrigerant cycle with an ejector according to a second preferred embodiment of the present invention.
Figure 5:
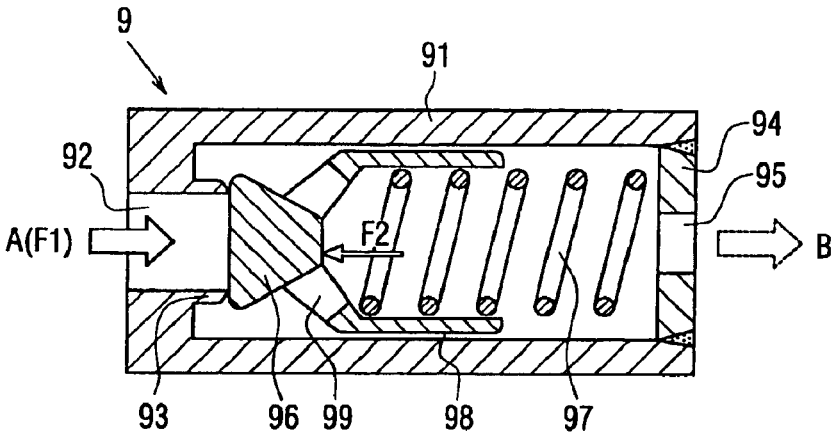
FIG. 5 is a cross-sectional view showing a control valve (differential pressure valve) used for the refrigerant cycle in FIG. 4.

The second embodiment of the present invention will be now described with reference to FIGS. 4–6. In the second embodiment, a control valve 9 having a structure different from that of the control valve 7 of the first embodiment is used, but the other parts are similar to those of the above-described first embodiment. In the second embodiment, the control valve 9 is a differential pressure valve as shown in FIG. 5. The control valve 9 includes a housing 91 made of a metal such as a stainless steel. The housing 91 has an inlet 92 communicating with a branch point F that is provided in the high-pressure refrigerant passage A for connecting the radiator 2 and the nozzle 31 of the ejector 3, and an outlet 95 communicating with the bypass passage B. The bypass passage B is connected to the refrigerant passage C between the evaporator 6 and the suction portion 32 of the ejector 3. Therefore, the housing 91 of the control valve 9 defines a part of the bypass passage B. Further, the housing 91 has a valve port 93 through which the inlet 92 communicates with the outlet 95, and an opening degree of the valve port 93 is adjusted by a valve body 96. The valve body 96 is pressed by a coil spring 97 made of a metal to the valve port 93.

The housing 91 includes a bottom portion having the inlet 92, a cylindrical body portion and a cover member 94 having the outlet 95. In the second embodiment, the bottom portion and the cylindrical body portion of the housing 91 are integrally formed. After the valve body 96 and the coil spring 97 are disposed in the housing 91, the cover member 94 is connected to the housing 91 by fastening such as welding and screwing. A guide skirt 98 for guiding the movement of the valve body 96 is disposed in the housing 91. When the valve body 96 moves, a cylindrical outer surface of the guide skirt 98 contacts an inner wall surface of the housing 91 so that the movement of the valve body 96 is guided. Plural holes 99 through which carbon dioxide as the refrigerant flows are provided in the guide skirt 98 at positions near the valve body 96.

Next, the operation of the control valve 9 (differential pressure valve) will be now described. As shown in FIG. 5, an operation force F1 from the inlet 92 is applied to the valve body 96 due to the refrigerant pressure from the radiator 2, so as to press the valve body 96 toward the outlet 95. On the other hand, an operation force F2 due to the refrigerant pressure at the outlet side of the evaporator 6 and the elastic force of the coil spring 97 is applied to the valve body 96 from a side of the outlet 95 toward the inlet 92.

That is, when the operation force F2 is larger than the operation force F1, the valve port 93 is closed by the valve body 96, and refrigerant does not flows through the bypass passage B. On the other hand, when the operation force F2 is smaller than the operation force F1, the valve port 93 is opened by the valve body 96, and refrigerant flows through the bypass passage B. That is, the control valve 9 is opened and closed by a differential pressure. The differential pressure relates to the elastic force of the coil spring 97 applied to the valve body 96, and the pressure difference between the pressure of the high-pressure refrigerant and the refrigerant pressure at the outlet side of the evaporator 6.

Figure 6:
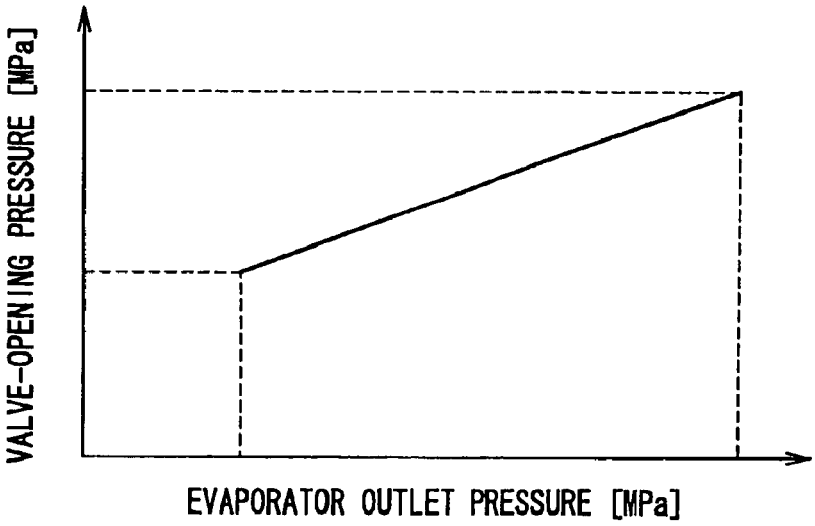
FIG. 6 is a graph showing operation characteristics of the differential pressure valve shown in FIG. 5.

FIG. 6 shows operation characteristics of the control valve 9. In the second embodiment, the differential pressure is the valve-opening pressure of the control valve 9. As shown in FIG. 6, when the evaporator outlet pressure, that is, the refrigerant pressure at the outlet side of the evaporator 6 becomes higher, the valve-opening pressure of the control valve 9 becomes larger. Generally, the cooling load is larger, as the refrigerant outlet pressure of the evaporator 6 becomes higher. On the other hand, when the cooling load is small, and the refrigerant pressure at the outlet side of the evaporator 6 becomes smaller, the valve-opening pressure of the control valve 9 becomes lower.

According to the second embodiment of the present invention, the control valve 9 is set to be opened when the pressure of high-pressure refrigerant from the radiator 2 that is upstream from the control valve 9 is larger than the refrigerant pressure at the outlet of the evaporator 6 that is downstream from the control valve 9, by a predetermined pressure difference. That is, when the differential pressure between front and rear of the control valve 9 is larger than a predetermined value (valve-opening pressure), the control valve 9 is opened to open the bypass passage B.

Because the differential pressure valve is used as the control valve 9, the pressure of refrigerant bypassing the nozzle 31 of the ejector 3 becomes higher as the cooling load is large and the pressure in the evaporator 6 becomes higher. Conversely, as the cooling load is smaller and the pressure inside the evaporator 6 becomes lower, the pressure of refrigerant bypassing the nozzle 31 of the ejector 3 becomes lower.

In a case where carbon dioxide is used as the refrigerant, when the refrigerant temperature at the outlet of the radiator 2 is the same, the enthalpy difference used for cooling becomes larger as the refrigerant pressure becomes higher. Therefore, when the cooling load is large, the valve-opening pressure of the control valve 9 becomes larger, and the cooling capacity can be increased. On the other hand, when the cooling load is small, the valve-opening pressure of the control valve 9 becomes smaller, and the cooling capacity can be reduced. Accordingly, the consumed power of the compressor 1 can be effectively reduced, and the COP of the refrigerant cycle can be improved.

(Third Embodiment)

Figure 7:
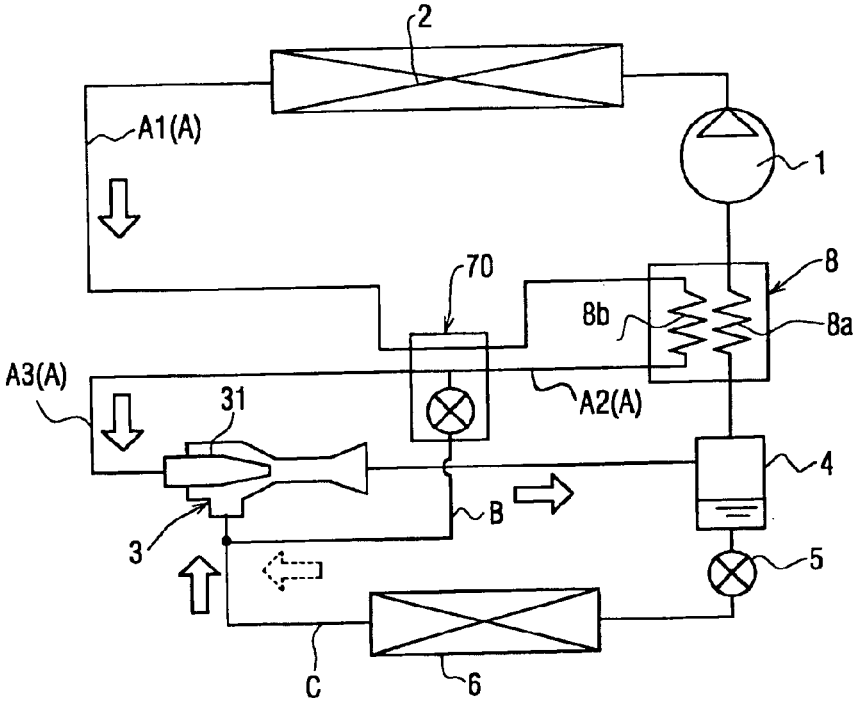
FIG. 7 is a schematic diagram showing a refrigerant cycle with an ejector according to a third preferred embodiment of the present invention.

The third embodiment of the present invention will be now described with reference to FIGS. 7 and 8. As shown in FIG. 7, in the third embodiment, an inner heat exchanger 8 for performing heat exchange between refrigerant to be sucked to the compressor 1 and high-pressure refrigerant flowing from the radiator 2 is added, as compared with the refrigerant cycle of the above-described first embodiment. The inner heat exchanger 8 is formed by brazing plural aluminum plates, for example. The inner heat exchanger 8 has therein a first refrigerant passage 8*a* through which refrigerant to be sucked into the compressor 1 from the gas-liquid separator 4 flows, and a second refrigerant passage 8*b* through which high-pressure refrigerant flowing from the radiator 2 flows. Generally, a flow direction of refrigerant flowing through the first refrigerant passage 8*a* is opposite to that flowing through the second refrigerant passage 8*b* in the inner heat exchanger 8. When the inner heat exchanger 8 is disposed in the refrigerant cycle, the refrigerant temperature to be sucked into the compressor 1 is increased, so the cooling capacity and the COP in the refrigerant cycle can be improved.

Figure 8:
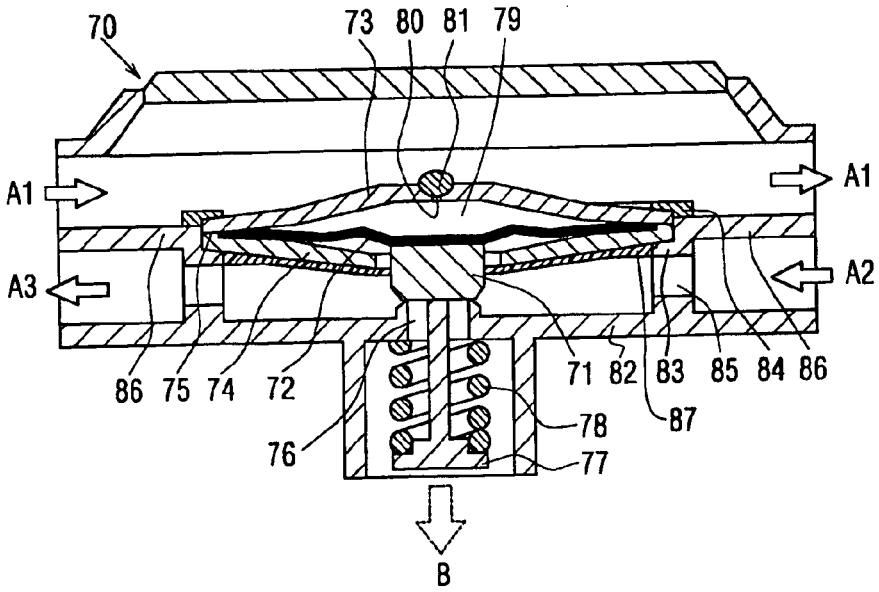
FIG. 8 is a cross-sectional view showing a control valve used for the refrigerant cycle in FIG. 7.

FIG. 8 shows a control valve 70 used for the refrigerant cycle of the third embodiment. In the third embodiment, a partition wall 86 is disposed for partitioning the high-pressure refrigerant passage A into a first refrigerant passage A1 on the upper case 73 and a second refrigerant passage A2, A3 on the side of the valve body 71. That is, the first refrigerant passage A1 above the upper case 73 and the second refrigerant passage A2, A3 in the control valve 70 are partitioned from each other by the partition wall 86. An insulation layer 87 made of resin is provided on an outer surface of the lower cover 74, for restricting heat from refrigerant after passing through the inner heat exchanger 7 from being transmitted to the diaphragm 72 in the seal space 79. In the control valve 70, the other parts are similar to the control valve 7 shown in FIG. 2 of the first embodiment.

Next, operation of the refrigerant cycle will be now described. Refrigerant flowing from the radiator 2 passes through the refrigerant passage A1 of the control valve 70, and is cooled in the inner heat exchanger 8 by low-temperature refrigerant to be sucked to the compressor 1. Thereafter, the refrigerant from the inner heat exchanger 8 passes through the control valve 70 from the refrigerant passage A2 to the refrigerant passage A3, and flows into the ejector 3. The operation of the control valve 70 is similar to the operation of the control valve 7 described in the first embodiment. That is, when the pressure of the high-pressure refrigerant is higher than the valve-opening pressure of the control valve 70, the control valve 70 is opened so that refrigerant flows through the bypass passage B. On the other hand, when the pressure of the high-pressure refrigerant is equal to or lower than the valve-opening pressure of the control valve 70, the control valve 70 is closed so that all refrigerant flows into the nozzle 31 of the ejector 3 while bypassing the bypass passage B.

In the refrigerant cycle of the third embodiment, the inner heat exchanger 8, where the refrigerant to be sucked to the compressor 1 is heat-exchanged with refrigerant flowing from the radiator 2, is provided. Further, the control valve 70 forms a part of the refrigerant passage A from the radiator 2 to the ejector 3, and the bypass passage B communicates with the refrigerant passage A through the valve port 76. The seal space 79 where the refrigerant gas is sealed by a predetermined density is formed in the refrigerant passage A. In addition, the control valve 70 includes the diaphragm 72 that is displaced in accordance with the pressure difference between outside and inside of the seal space 79, and the valve body 71 is moved with the displacement of the diaphragm 72 to open and close the valve port 76. In the third embodiment, the insulation layer 87 is provided on the outer surface of the lower cover 74, so that heat from the refrigerant passing through the refrigerant passage A1 before being cooled in the inner heat exchanger 8 is mainly transmitted to the refrigerant gas in the seal space 79.

Accordingly, when the refrigerant pressure in the refrigerant passage A1 for supplying refrigerant from the radiator 2 to the inner heat exchanger 8 is larger than the inner pressure in the seal space 79, the diaphragm 72 is displaced, so that the valve port 76 in the refrigerant passage A2 is opened. Thus, the present invention can be effectively used for the refrigerant cycle having the inner heat exchanger 8.

In the third embodiment, similarly to the above-described first embodiment, when the pressure of the high-pressure refrigerant in the high-pressure refrigerant passage A1 is lower than a predetermined pressure (valve-opening pressure), all of the refrigerant from the radiator 2 passes through the nozzle 31 of the ejector 3. On the other hand, when the pressure of the high-pressure refrigerant in the refrigerant passage A1 is higher than the predetermined pressure (valve-opening pressure), a part of the high-pressure refrigerant from the radiator 2 flows into the bypass passage B while bypassing the nozzle of the ejector 3. Therefore, it can prevent the pressure of the high-pressure refrigerant from being excessively increased due to the increase of the refrigerant flow amount.

Further, in the third embodiment, because the inner pressure of the seal space 79 changes in accordance with the temperature of the high-pressure refrigerant flowing from the radiator 2, the valve-opening pressure of the control valve 70 also changes in accordance with the temperature of the high-pressure refrigerant. Accordingly, the valve-opening pressure of the control valve 7 can be set to approximately correspond to the optimum control line where the efficiency (COP) of the refrigerant cycle becomes maximum. Therefore, the operation of the refrigerant cycle can be stably performed while the COP of the refrigerant cycle can be improved.

(Fourth Embodiment)

Figure 9:
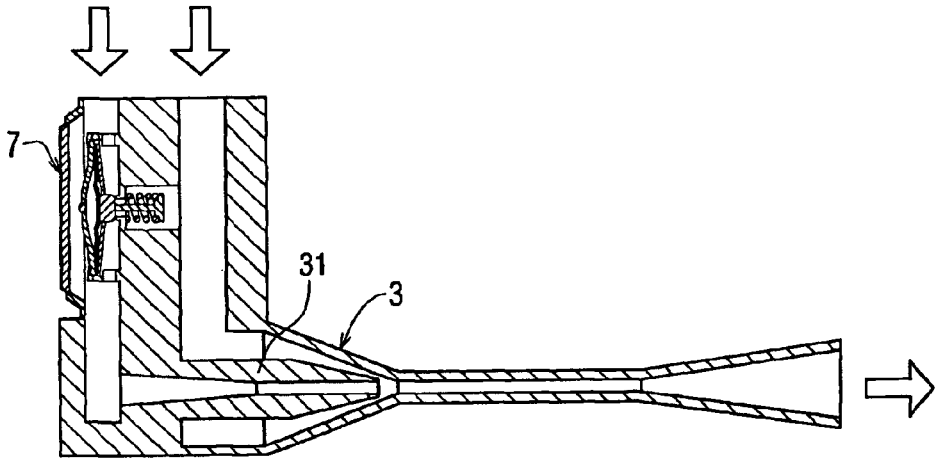
FIG. 9 is a cross-sectional view showing an example of an integrated structure of an ejector and a control valve, according to a fourth embodiment of the present invention.
Figure 10:
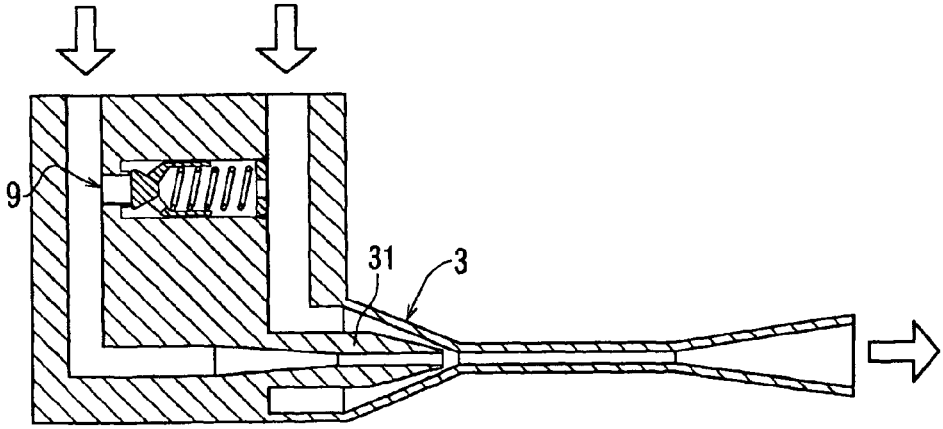
FIG. 10 is a cross-sectional view showing another example of an integrated structure of an ejector and a differential pressure valve, according to the fourth embodiment.

In the fourth embodiment, the control valve 7, 9, 70 and the ejector 3 in the above-described embodiments are integrated. For example, in FIG. 9, the control valve 7 described in the first embodiment is integrated with the ejector 3. In FIG. 10, the control valve 9 (differential pressure valve) described in the second embodiment is integrated with the ejector 3. Further, the control valve 70 described in the third embodiment can be integrated with the ejector 3. Even in this case, the structure and operation of the control valve 7, 9, 70 are similar to those of the above-described embodiments.

According to the fourth embodiment, because the control valve 7, 9, 70 is integrated with the ejector 3, a pipe structure between the control valve 7, 9, 70 and the ejector 3 can be made simple, and the integrated structure has a reduced size. Accordingly, the integrated structure of the control valve 7, 9, 70 and the ejector 3 can be readily mounted on a vehicle.

(Fifth Embodiment)

Figure 11:
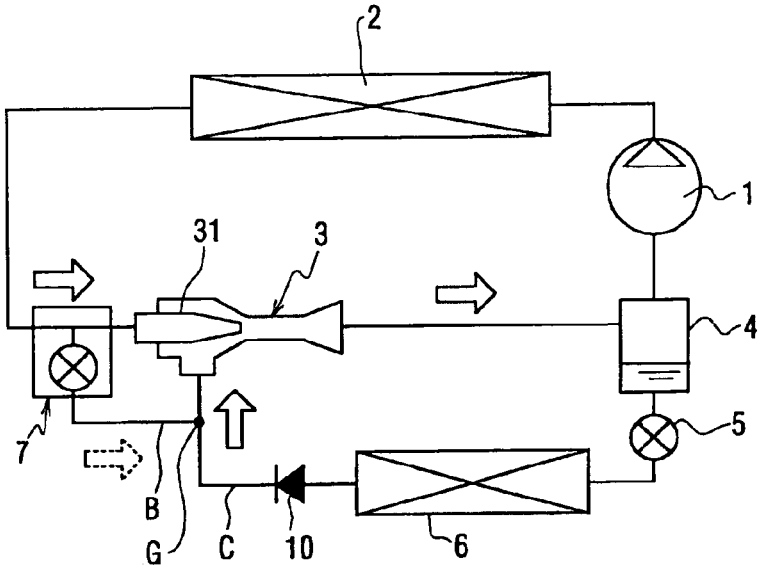
FIG. 11 is a schematic diagram showing a refrigerant cycle with an ejector according to a fifth preferred embodiment of the present invention.

The fifth embodiment of the present invention will be now described with reference to FIG. 11. In the fifth embodiment, a check valve 10 is disposed in the refrigerant passage C between the outlet of the evaporator 6 and a join portion G at which the bypass passage B is joined with the refrigerant passage C. Therefore, it can prevent refrigerant after passing through the bypass passage B from being reversely flowing toward the evaporator 6, thereby preventing the refrigerant circulation from staying. In the fifth embodiment, the other parts are similar to those of the above-described first embodiment.

Similarly, the check valve 10 can be disposed in the refrigerant cycle described in the second and third embodiments. Further, the check valve 10 can be disposed at any position in a refrigerant passage from the liquid refrigerant outlet of the gas-liquid separator 4 and the join portion G.

(Sixth Embodiment)

Figure 12:
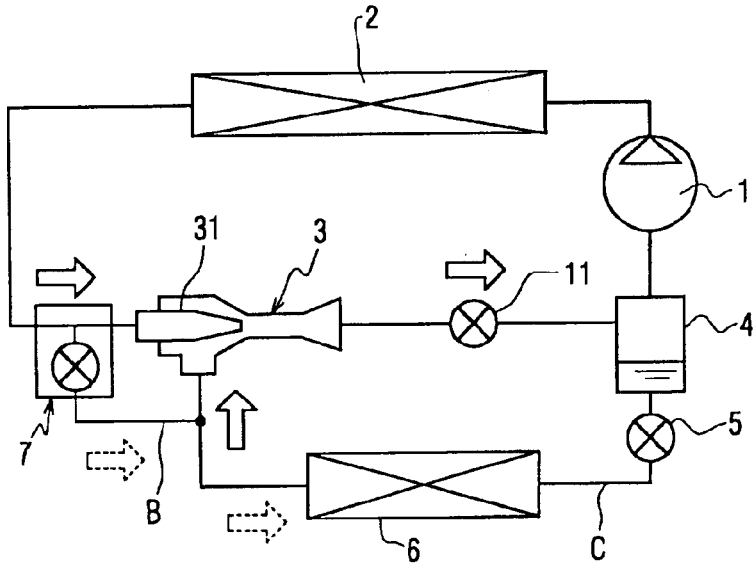
FIG. 12 is a schematic diagram showing a refrigerant cycle with an ejector according to a sixth preferred embodiment of the present invention.
Figure 13:
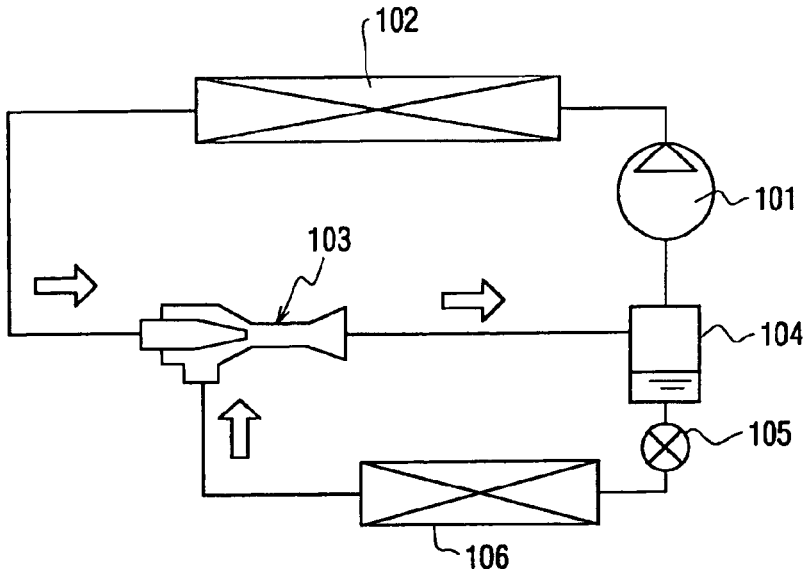
FIG. 13 PRIOR ART
FIG. 13 is a schematic diagram showing a refrigerant cycle with an ejector in a prior art.
Figure 14:
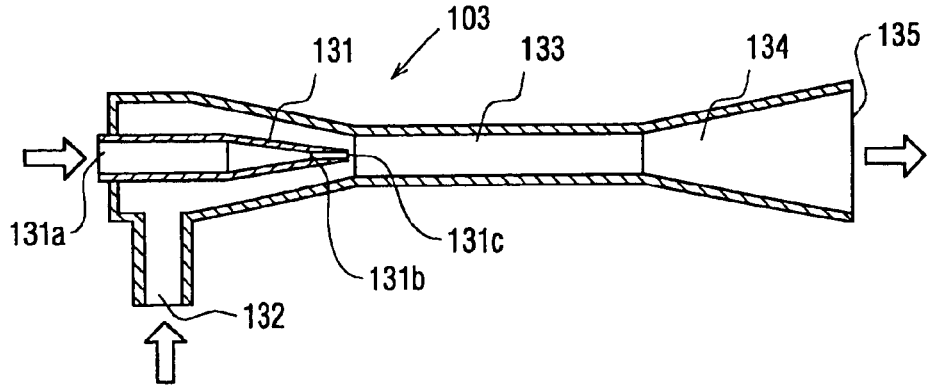
FIG. 14 PRIOR ART
FIG. 14 is a cross-sectional view showing the ejector in FIG. 13.

In the sixth embodiment, as shown in FIG. 12, a switching valve 11 for switching a refrigerant flow is disposed in a refrigerant passage between the outlet of the ejector 3 and the gas-liquid separator 4. In the sixth embodiment, the switching valve 11 is closed at the same time as the opening time of the control valve 7. Accordingly, when the bypass passage B is opened by the control valve 7, refrigerant from the radiator 2 flows through the evaporator 6 after passing through the control valve 7 and the bypass passage B, and flows into the gas-liquid separator 4. In this case, the refrigerant from the radiator bypasses all the ejector 3, and refrigerant circulates similarly to a general expansion-valve cycle. Accordingly, it can prevent the refrigerant pressure from being excessively increased due to the ejector 3. In the sixth embodiment, the other parts are similar to those of the above-described first embodiment.

In the sixth embodiment, instead of the control valve 7, the control valve 9, 70 described in the second and third embodiments can be used.

Although the present invention has been fully described in connection with the preferred embodiments thereof with reference to the accompanying drawings, it is to be noted that various changes and modifications will become apparent to those skilled in the art.

For example, in the above-described embodiments of the present invention, carbon dioxide is used as the refrigerant in the refrigerant cycle. However, the present invention can be applied to the refrigerant cycle where freon is used as the refrigerant. In the above-described embodiments of the present invention, the refrigerant cycle can used for a vapor-compression refrigerator for cooling a showcase for refrigerating foods, and can be used for an air conditioner.

Further, in the above-described embodiment, the control valve 7, 9, 70 operates mechanically. However, as the control valve, an electrical valve such as an electrical expansion valve with a fully closing function can be used.

Such changes and modifications are to be understood as being within the scope of the present invention as defined by the appended claims.

What is claimed is:

1. A refrigerant cycle comprising:

a compressor for compressing refrigerant;

a high-pressure heat exchanger for radiating heat of high-pressure refrigerant discharged from the compressor;

a low-pressure heat exchanger for evaporating low-pressure refrigerant after being decompressed;

an ejector including a nozzle for decompressing and expanding refrigerant flowing from the high-pressure heat exchanger by converting pressure energy of refrigerant to speed energy of the refrigerant, and a pressure-increasing portion that is disposed to increase a pressure of refrigerant by converting the speed energy of refrigerant to the pressure energy of refrigerant while mixing refrigerant injected from the nozzle and refrigerant sucked from the low-pressure heat exchanger; and a gas-liquid separator for separating refrigerant from the ejector into gas refrigerant and liquid refrigerant, the gas-liquid separator having a gas refrigerant outlet coupled to a refrigerant suction side of the compressor, and a liquid refrigerant outlet coupled to a refrigerant inlet side of the low-pressure heat exchanger; and a control valve disposed in a bypass passage through which a part of refrigerant from the high-pressure heat exchanger flows into a low-pressure refrigerant passage between the low-pressure heat exchanger and a suction port of the ejector, wherein the control valve opens the bypass passage so that refrigerant flows through the bypass passage when a pressure of the refrigerant from the high-pressure heat exchanger becomes in a predetermined condition.

2. The refrigerant cycle according to claim 1, wherein the control valve includes a housing for defining a part of a high-pressure refrigerant passage from the high-pressure heat exchanger to the nozzle of the ejector;

a valve port through which the high-pressure refrigerant passage communicates with the bypass passage;

a case member for forming a seal space in which a gas refrigerant is sealed by a predetermined density, the seal space being placed in the high-pressure refrigerant passage of the housing;

a displacement member that displaces in accordance with a pressure difference between inside and outside of the seal space; and a valve body that opens and closes the valve port in accordance with a displacement of the displacement member, and the displacement member moves in a direction for opening the valve port, when a pressure in the high-pressure refrigerant passage is higher than the inside pressure of the seal space.

3. The refrigerant cycle according to claim 1, wherein the control valve is disposed to open the bypass passage, when a pressure difference between a pressure of refrigerant flowing from the high-pressure heat exchanger at a position upstream from the control valve and a pressure of refrigerant at an outlet side of the low-pressure heat exchanger at a position downstream from the control valve is larger than a predetermined value.

4. The refrigerant cycle according to claim 1, further comprising an inner heat exchanger for performing a heat exchange between refrigerant to be sucked into the compressor and refrigerant flowing from the high-pressure heat exchanger, wherein the control valve includes a housing for defining a part of a first high-pressure refrigerant passage through which refrigerant from the high-pressure heat exchanger flows to the inner heat exchanger, and for defining a part of a second high-pressure refrigerant passage through which refrigerant from the inner heat exchanger flows to the nozzle of the ejector;

a valve port through which the second high-pressure refrigerant passage communicates with the bypass passage;

a case member for forming a seal space in which a gas refrigerant is sealed by a predetermined density, the seal space being placed at least in the first high-pressure refrigerant passage of the housing;

a displacement member that displaces in accordance with a pressure difference between inside and outside of the seal space; and a valve body that opens and closes the valve port in accordance with a displacement of the displacement member, and the displacement member moves in a direction for opening the valve port, when a pressure in the first high-pressure refrigerant passage is higher than the inside pressure of the seal space.

5. The refrigerant cycle according to claim 1, wherein the ejector and the control valve are integrated to form an integrated member.

6. The refrigerant cycle according to claim 1, further comprising a check valve, disposed in a refrigerant passage from a liquid refrigerant outlet of the gas liquid separator to a join point where the bypass passage is joined with the low-pressure refrigerant passage, for preventing refrigerant from reversely flowing.

7. The refrigerant cycle according to claim 1, further comprising a switching valve, disposed between an outlet of the ejector to the gas-liquid separator, for switching a refrigerant flow from the outlet of the ejector to the gas-liquid separator, wherein, when the control valve opens the bypass passage, the switching valve closes the refrigerant flow from the outlet of the ejector to the gas-liquid separator.

8. The refrigerant cycle according to claim 1, wherein the control valve decompresses refrigerant when being opened.

9. The refrigerant cycle according to claim 1, wherein the high-pressure refrigerant discharged from the compressor has a pressure equal to or higher than the critical pressure of the refrigerant.

* * * * *